United States Patent [19]

Sattelberg et al.

[11] Patent Number: 4,461,399

[45] Date of Patent: Jul. 24, 1984

[54] LIQUID STORAGE TANK CONDUIT CONNECTION

[75] Inventors: Stanley E. Sattelberg, Naperville; George A. Baker, Batavia, both of Ill.

[73] Assignee: Chicago Bridge & Iron Company, Oak Brook, Ill.

[21] Appl. No.: 382,347

[22] Filed: May 27, 1982

[51] Int. Cl.[3] ..... B65D 90/06

[52] U.S. Cl. ..... 220/444; 62/47; 220/440; 220/465; 220/901

[58] Field of Search ..... 137/577, 585, 264, 577.5; 52/245; 220/901, 902, 442, 444, 465, 440, 420; 138/121, 114, 118; 403/50, 28, 31, 39, 83; 62/47; 285/DIG. 5

[56] References Cited

U.S. PATENT DOCUMENTS

| | | | |
|---|---|---|---|
| 2,393,964 | 2/1946 | Boardman | 220/442 |
| 2,777,295 | 1/1957 | Bliss et al. | 220/18 X |
| 3,241,703 | 3/1966 | Korin et al. | 220/446 |
| 3,446,387 | 5/1969 | Webb | 220/465 X |
| 3,473,575 | 10/1969 | Vogelsang et al. | 138/114 X |
| 3,613,934 | 10/1971 | Leonard | 220/440 X |
| 3,638,431 | 2/1972 | Shelander | 220/18 X |
| 3,655,224 | 4/1972 | Carberry et al. | 138/121 X |
| 3,666,132 | 5/1972 | Yamamoto et al. | 220/901 X |
| 3,810,839 | 5/1974 | Creaser | 220/444 X |
| 4,098,426 | 7/1978 | Gerhard | 220/444 X |
| 4,162,093 | 7/1979 | Sigmund | 138/114 X |

*Primary Examiner*—Allan N. Shoap
*Assistant Examiner*—Robert Petrik
*Attorney, Agent, or Firm*—Merriam, Marshall & Bicknell

[57] ABSTRACT

A liquid storage tank for storing a liquid at a temperature substantially above or below atmospheric temperature comprising a primary liquid containment vessel capable of storing liquid; an outer vessel spaced outwardly from and surrounding a substantial portion of the primary vessel; a liquid conduit communicating with and joined to the primary liquid containment vessel and extending through an oversized hole in the outer vessel; a flexible expansion and contraction unit surrounding the liquid conduit, in spaced apart arrangement, exterior of the outer vessel with the expansion unit having an end joined to the outer vessel around the oversized hole and another end joined to the liquid conduit; at least one closeable access port in the flexible unit for feeding insulation into the flexible unit and around the liquid conduit; and insulation around the liquid conduit and inside the flexible unit.

7 Claims, 3 Drawing Figures

LIQUID STORAGE TANK CONDUIT CONNECTION

This invention relates to liquid storage tanks. More particularly, this invention is concerned with improved equipment and structures for insulating conduits for filling and emptying storage tanks of liquids at temperatures substantially above or below atmospheric temperature.

BACKGROUND OF THE INVENTION

Storage tanks for liquids are widely used commercially. Among the liquid products stored in tanks are gasoline, oil and ammonia, and liquefied gases such as natural gas (methane), propane, ethylene, oxygen and hydrogen. Because some of the liquid products are stored very cold, the tanks have been insulated. Many of the tanks used for storing cold liquids are double-shelled. The second or outer shell was originally developed to maintain large thicknesses of insulation in place. The outer shell was generally not designed to hold or contain the liquid, except for the warmer products such as butane, ammonia and perhaps propane, if the inner shell failed. This was primarily because the metal used for the outer shell was not one which could withstand cryogenic temperatures without failing. More recently, outer shells have been designed using special metals or concrete to classify them as true secondary containment vessels. Sattelberg et al U.S. Pat. No. 3,352,443 shows such a tank.

Storage tanks of the described types often have a conduit which communicates with the inner vessel and extends through both vessel shells. The conduit is used to fill and empty the tank. In double-shelled tanks with flat spaced apart bottoms, the conduit has been located in a trough or chamber at least partly beneath the inner bottom and in communication with the annular space between the two shells or vessels.

Properly insulating the conduit in the trough is very important for storage of a liquid at a highly elevated, or greatly reduced, temperature. In one approach at insulation, granular insulation, such as perlite, has been permitted to flow from the annular space into the trough space. Because the angle of repose of the granular insulation is about 30°, sufficient insulation is unable to flow into and fill that part of the trough beneath the inner vessel bottom. Manually pushing the insulation into the back of the trough has not proven reliable because of an inability to see if all the space has been filled.

Another shortcoming of past insulating procedures is that the conduit and trough had to be insulated before the entire tank was closed and shell insulation completed. This barred subsequent inspection and removal and replacement of the insulation in the trough and around the conduit. Similar problems are involved when the conduit penetrates inner and outer vessel roofs.

A need accordingly exists for improved equipment and structures in liquid storage tanks which will permit insulation, after the tank is closed, of the conduit and the space surrounding it, and subsequent inspection and replacement of the insulation, regardless of the position of the conduit penetration into the tank.

SUMMARY OF THE INVENTION

According to the invention, there is provided a liquid storage tank for storing a liquid at a temperature substantially above or below atmospheric temperature comprising an inner liquid containment vessel capable of storing liquid; an outer vessel spaced outwardly from and surrounding a substantial portion of the primary vessel; a liquid conduit communicating with and joined to the primary liquid containment vessel and extending through an oversized hole in the outer vessel; a flexible expansion and contraction unit surrounding the liquid conduit, in spaced apart arrangement, exterior of the outer vessel with the expansion unit having an end joined to the outer vessel around the oversized hole and another end joined to the liquid conduit; at least one closeable access port in the flexible unit for feeding insulation into the flexible unit and around the liquid conduit; and insulation around the liquid conduit and inside the flexible unit.

While the invention is useful regardless of where the conduit penetrates the tank, whether it be the bottom, wall or roof area, it is especially useful in a tank in which the primary and containment vessel and the outer vessel have flat bottoms and vertical circular cylindrical walls; the conduit communicates with the primary containment vessel through its bottom; and the oversize hole through which the conduit extends is positioned in the wall of the outer vessel lower than the inner containment vessel bottom.

The flexible expansion and contraction unit desirably includes a metal bellows section, surrounding the conduit, to provide the desired dimensional adjustability. More specifically, the flexible expansion and contraction unit desirably includes a metal cylindrical ring at one end joined to the wall of the outer vessel around the oversized hole, a metal cylindrical ring at the other end joined by an end closing plate to the conduit surface, and a metal bellows section between and joined to the two metal cylindrical rings.

When the liquid storage tank has flat inner and outer bottoms the conduit desirably is located in a trough, filled with granular insulation, in part between the inner and outer bottoms.

It is to be understood that the invention is useful in tanks as described, whether or not the outer vessel is designed to serve as a secondary liquid containment vessel if the inner primary liquid containment vessel fails. The invention is intended to be useful in tanks in which the outer vessel serves primarily as an insulation maintaining structure as well as in tanks in which the outer vessel serves that purpose and if necessary can also function as a secondary liquid containment vessel.

DETAILED DESCRIPTION OF THE DRAWINGS

Figure 1:
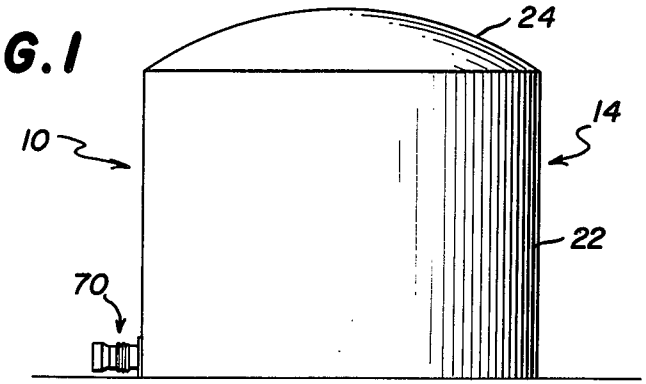
FIG. 1 is an elevational view of a double-shelled insulated tank equipped with apparatus for insulating a filling and emptying conduit and the surrounding space.

To the extent it is reasonable and practical, the same or similar elements or parts which appear in the various views of the drawings will be identified by the same numbers.

The storage tank 10 is of the double-shelled type having an inner containment vessel 12 and an outer containment vessel 14. The inner containment vessel has a flat circular bottom 16 and a vertical circular cylindrical wall 18 which is closed at the top by a domed roof or suspended ceiling, not shown. The outer vessel 14 has a flat circular bottom 20 and a vertical circular cylindrical wall 22 which supports domed outer roof 24.

The outer vessel bottom 20 rests on earth 26. Footing 28 is positioned beneath outer wall 22 to give it necessary support. Load bearing insulating blocks 30 rest on outer bottom 20 and support inner vessel bottom 16. The blocks 30 extend over to the outer wall 22 and have a top surface designated by the line 32. Footing 34 is located beneath inner wall 18 to distribute the load. Grout 36 is positioned between footing 34 and inner bottom 16 to achieve load distributing contact.

A trough or chamber 40 extends from outer wall 22 to beneath inner bottom 16 and ends at a wall face 42 formed by blocks 30. The spaced apart parallel side walls of the trough 40 are also formed of blocks 30. The side walls extend vertically between inner and outer bottoms 16 and 20 which define the top and bottom of the trough. If desired, a layer of rigid insulation can be placed along the line 32 to prevent granular insulation 46 in the annular space from flowing into the trough 40.

Conduit 50 is positioned in trough 40. The elbow 52 on the inner end portion of conduit 50 extends through inner bottom 16 and reinforcing plate 54 so as to place the conduit in fluid communication with the interior space of the inner containment vessel 12. A valve 56 is provided to close the inner end of the conduit if that becomes desirable. The other end of the conduit 50 projects through an oversized hole 58 in outer wall 22. The area around the hole 58 in the outer wall is reinforced by plate 60.

The outer end of conduit 50 is provided with a flange 62 which is adapted to be connected to flange 64 on conduit 66. Support rod 68 prevents conduit 50 from sagging.

Flexible expansion and contraction unit 70 axially surrounds the outer end portion of conduit 50. The unit 70 contains a first metal cylindrical ring 72 at one end partially inserted into hole 58 and joined, such as by welding, to wall 22 and reinforcing plate 60. Another metal cylindrical ring 74 is located at the outer end of the unit 70. Metal bellows 76 extends between and is joined to the adjacent edges of rings 72 and 74.

Bellows 76 is made of thin metal which permits it to expand and contract readily without breaking when it is placed in tension or compression as a result of forces applied to it by axial movement of conduit 50. Axial movement of conduit 50 takes place when it is heated or cooled by liquid therein or in the tank. Plate 78 is connected, such as by welding, to the outer surface of conduit 50 and to the end of ring 74. As a result, relative movement of conduit 50 applies a tensile or compressive force to unit 70 which is reflected by appropriate axial expansion or contraction of the bellows 76.

At least one port 80 is provided in unit 70 so that the insulation content therein can be inspected. The drawings specifically show five ports 80. Each port 80 is formed of an internally threaded nipple 82 set in an appropriate hole and welded in place. A plug 84 is then removably screwed into the nipple 82. The ports 80, in addition to providing inspection holes, can also be used to feed granular insulation into the trough 40 as well as into unit 70. A port 80 in plate 78 is especially useful for feeding-in granular insulation since a lance or supply tube can be inserted through the port and pushed in as far as appropriate to deposit the insulation.

Figure 2:
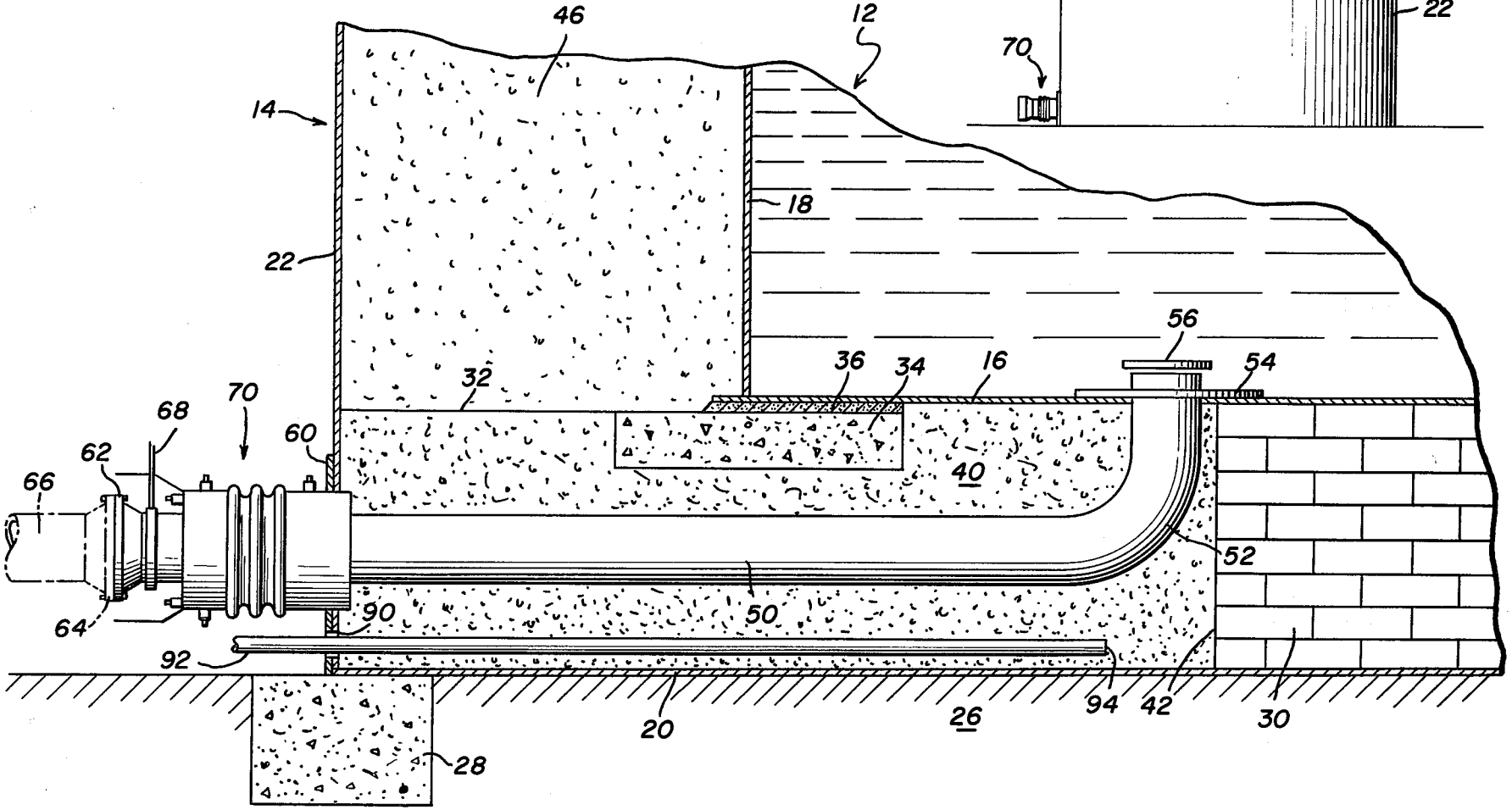
FIG. 2 is a vertical view, partially in section, of the lower portion of the tank shown in FIG. 1 showing the filling and emptying conduit and associated equipment.
Figure 3:
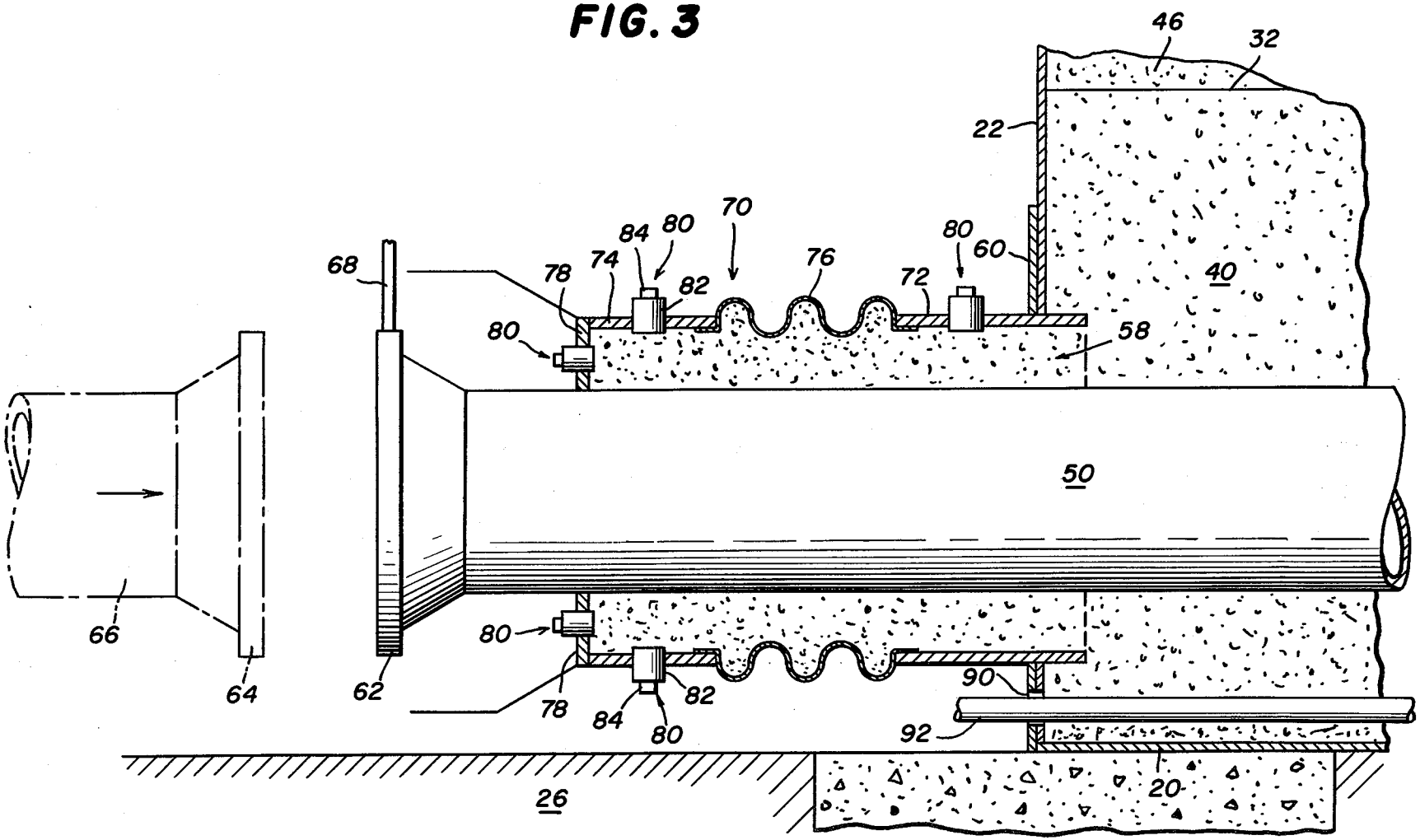
FIG. 3 is an enlarged view, partially exploded and partially in section, of the flexible expansion and contraction unit shown in FIG. 2.

An alternative way to supply granular insulation is to provide a pluggable hole 90 which extends through plate 60 and outer wall 22. Since the trough 40 is approximately square in lateral cross-section, the hole 90 can be placed in a lower corner of the square face of plate 60 so as to be readily accessible even with unit 70 in place. A lance or tube 92 can then be inserted horizontally through hole 90. The front end 94 of lance 92 can be located near the face 42 of insulation blocks 30 (FIG. 2). By means of an eductor or pressurized container feeding air under pressure, granular insulation, such as perlite, is blown through lance 92. The insulation exits the lance and is blown back into unit 70 and the adjacent trough space. One or more of the ports 80 can be opened to observe the interior of unit 70. In addition, a porous fiber glass blanket can be placed along the line 32 over the trough so that air can flow through it and out through the insulation wall space if insulation 46 has not yet been installed. Otherwise this blanket is not needed. The build-up of insulation proceeds from inside of unit 70 into the front portion of trough 40 and then progressively towards block face 42. If the insulation 46 in the tank wall has been put in place before the trough 40 is to be insulated (this being acceptable) the trough and the unit 70 can be filled in two steps. In this case no insulating blanket is put at line 32. Therefore, insulation 46 flows into the trough 40, isolating hole 58 from the partially filled trough 40. In that case, the inward portion of trough 40 is insulated by use of lance 92, and unit 70 is insulated through top front nozzle hole 80. Once the trough is full of granular insulation and will take no more, the eductor is stopped and lance 92 removed. Hole 90 is then suitably plugged and the ports 84, if open, closed. At some later time, if additional insulation is to be added to the trough the described procedure can be repeated. Of course, insulation can also be added through one or more of ports 80 to insulate that part of conduit 50 inside of unit 70.

The foregoing detailed description has been given for clearness of understanding only, and no unnecessary limitations should be understood therefrom, as modifications will be obvious to those skilled in the art.

What is claimed is:

1. A liquid storage tank for storing a liquid at a temperature substantially above or below atmospheric temperature comprising:

a primary liquid containment vessel capable of storing liquid;

an outer vessel spaced outwardly from and surrounding a substantial portion of the primary vessel;

a liquid conduit communicating with and joined to the primary liquid containment vessel and extending through an oversized hole in the outer vessel;

a flexible expansion and contraction unit surrounding the liquid conduit, in spaced apart arrangement, exterior of the outer vessel with the expansion unit joined to the outer vessel around the oversized hole and also joined to the liquid conduit;

at least one closeable access port in the flexible unit for inspecting insulation in, and feeding insulation into, the flexible unit and around the liquid conduit; and insulation around the liquid conduit and inside the flexible unit.

2. A liquid storage tank according to claim 1 in which the primary containment vessel and the outer vessel have flat bottoms and vertical circular cylindrical walls; the conduit communicates with the primary containment vessel through its bottom; and the oversize hole through which the conduit extends is positioned in the wall of the outer vessel lower than the inner containment vessel bottom.

3. A liquid storage tank according to claim 1 or 2 in which the flexible expansion and contraction unit includes a metal bellows section surrounding the conduit.

4. A liquid storage tank according to claim 1 or 2 in which the flexible expansion and contraction unit includes a metal cylindrical ring at one end joined to the wall of the outer vessel around the oversized hole and a metal cylindrical ring at the other end joined by an end closing plate to the conduit surface, and a metal bellows section between and joined to the two metal cylindrical rings.

5. A liquid storage tank according to claim 2 in which the conduit is located in a trough, filled with granular insulation, in part between the inner and outer bottoms.

6. A liquid storage tank for storing a liquid at a temperature substantially above or below atmospheric temperature comprising:

a primary liquid containment vessel capable of storing liquid;

an outer vessel spaced outwardly from and surrounding a substantial portion of the primary vessel;

a liquid conduit communicating with and joined to the primary liquid containment vessel and extending through an oversized hole in the outer vessel;

a flexible expansion and contraction unit surrounding the liquid conduit, in spaced apart arrangement, exterior of the outer vessel with the expansion unit having an end joined to the outer vessel around the oversized hole and another end joined to the liquid conduit;

at least one closeable access port in the flexible unit for inspecting insulation in, and feeding insulation into, the flexible unit and around the liquid conduit;

insulation around the liquid conduit and inside the flexible unit; and a closeable access port in the outer vessel spaced from said expansion and contraction unit and said oversized hole for inspecting and feeding insulation around the liquid conduit.

7. A liquid storage tank for storing a liquid at a temperature substantially above or below atmospheric temperature comprising:

a primary liquid containment vessel capable of storing liquid;

an outer vessel spaced outwardly from and surrounding a substantial portion of the primary vessel;

a liquid conduit communicating with and joined to the primary liquid containment vessel and extending through an oversized hole in the outer vessel;

a flexible expansion and contraction unit surrounding the liquid conduit, in spaced apart arrangement, exterior of the outer vessel with the expansion unit having an end joined to the outer vessel around the oversized hole and another end joined to the liquid conduit;

the primary containment vessel and the outer vessel having flat bottoms and vertical circular cylindrical walls; the conduit communicating with the primary containment vessel through its bottom; and the oversize hole through which the conduit extends being positioned in the wall of the outer vessel lower than the inner containment vessel bottom;

the liquid conduit being located in a trough in part between the inner and outer bottoms;

at least one closeable access port in the flexible unit for inspecting insulation in, and feeding insulation into, the flexible unit and around the liquid conduit;

a closeable access port, in the outer vessel wall, adjoining the flexible expansion and contraction unit, for feeding insulation into the trough and around the conduit and for inspecting such insulation; and insulation in the trough and around the liquid conduit and inside the flexible unit.

* * * * *